United States Patent [19]

Faup

[11] 3,972,389

[45] Aug. 3, 1976

[54] ELEVATOR STOP CONTROL ARRANGEMENT

[75] Inventor: John Joseph Faup, Oradell, N.J.

[73] Assignee: Otis Elevator Company, New York, N.Y.

[22] Filed: Sept. 23, 1974

[21] Appl. No.: 508,121

[52] U.S. Cl. ..... 187/29 R
[51] Int. Cl.² ..... B66B 1/36
[58] Field of Search ..... 187/29

[56] References Cited

UNITED STATES PATENTS 3,759,350 9/1973 Caputo et al. ..... 187/29

*Primary Examiner*—Robert K. Schaefer
*Assistant Examiner*—W. E. Duncanson, Jr.
*Attorney, Agent, or Firm*—Robert T. Mayer

[57] ABSTRACT

Apparatus for the control system of an elevator in which the arrival of the elevator at the rated speed stopping distance from a landing at which it is to stop while traveling at less than the rated speed delays the initiation of a stopping operation for that landing until the car attains an optimum speed.

8 Claims, 6 Drawing Figures

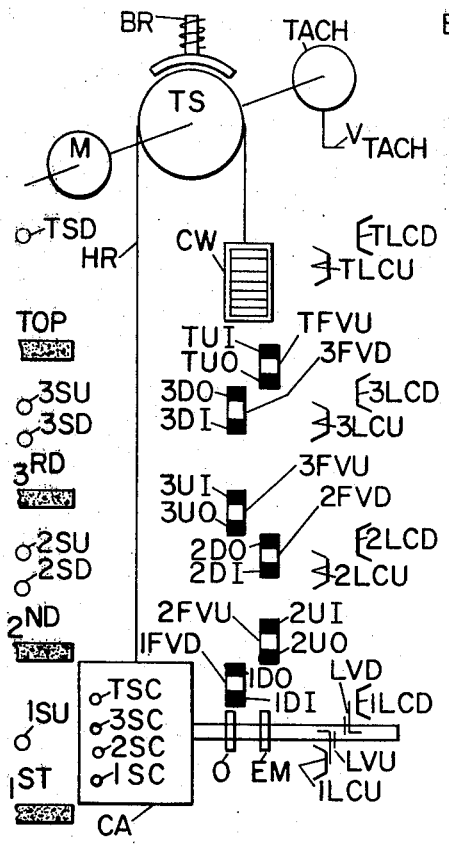
FIG. I
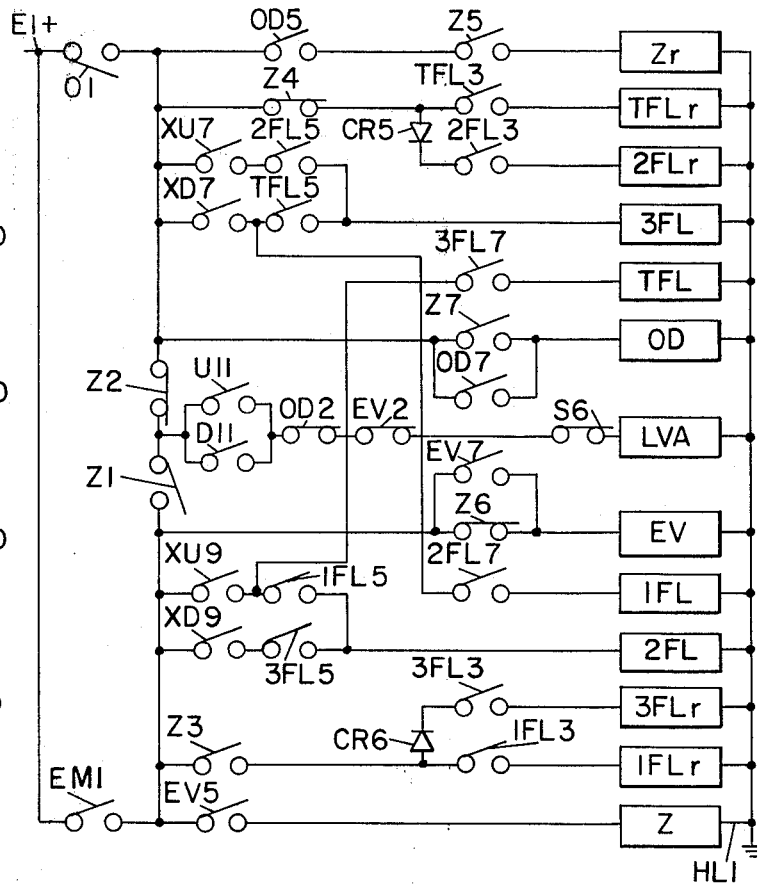
FIG. III
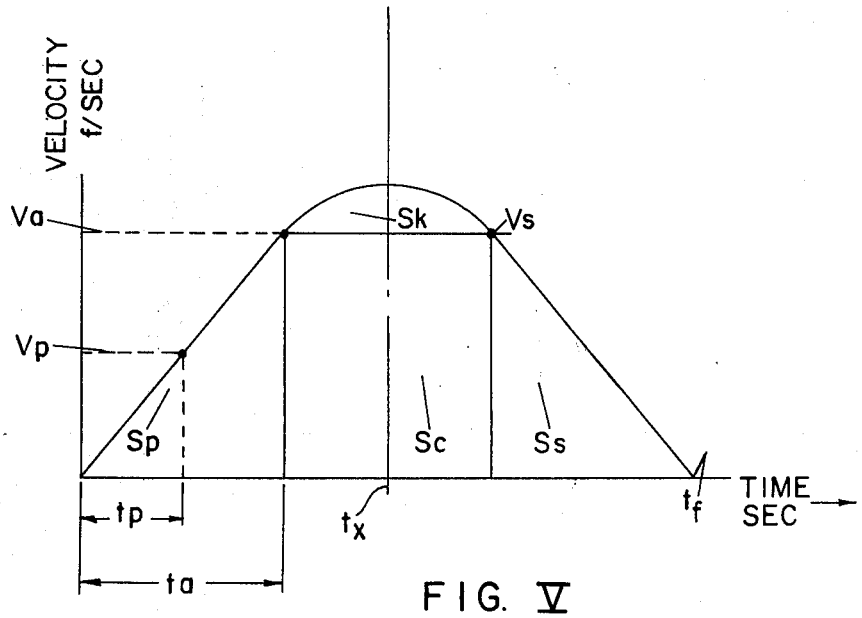
FIG. V

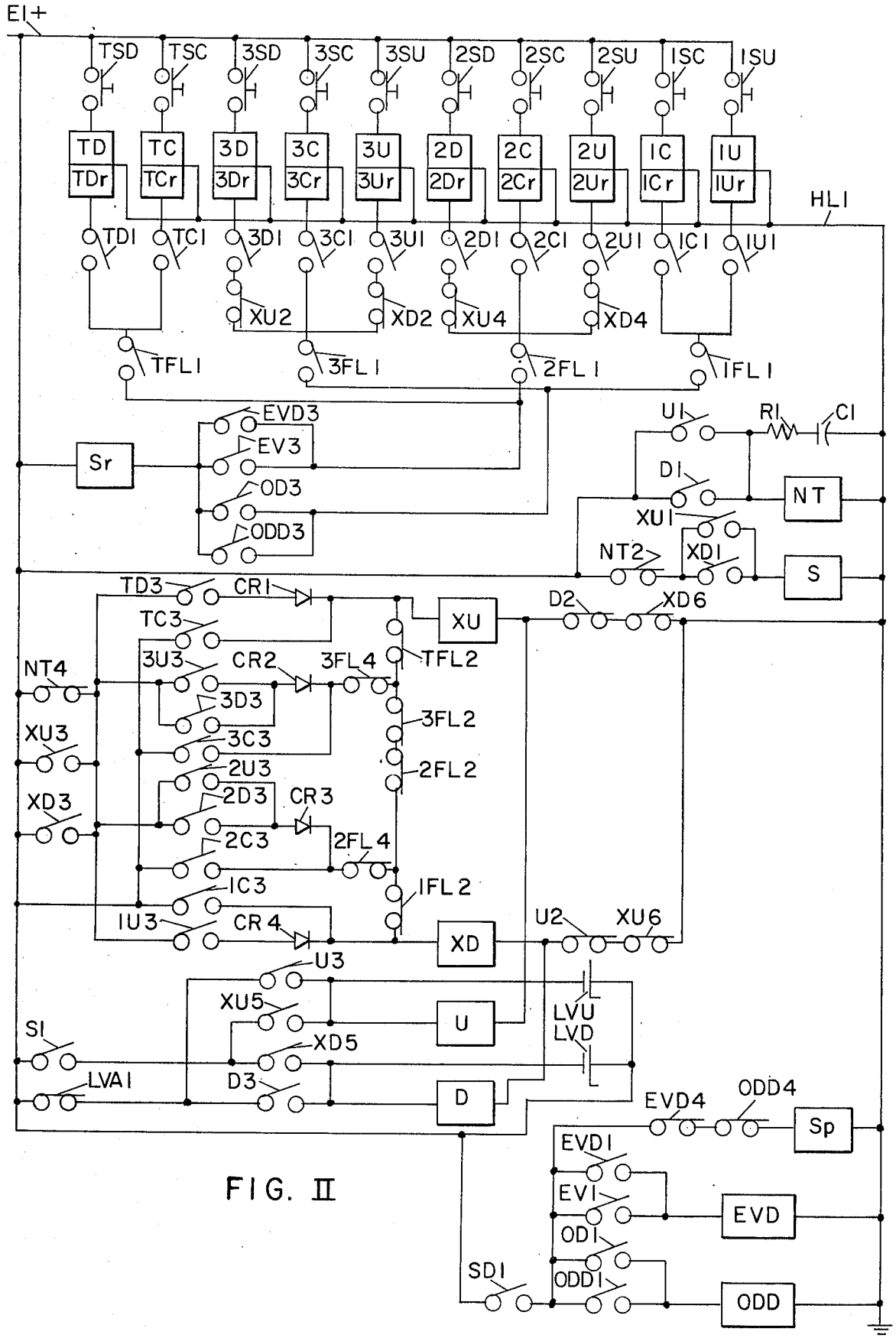
FIG. II

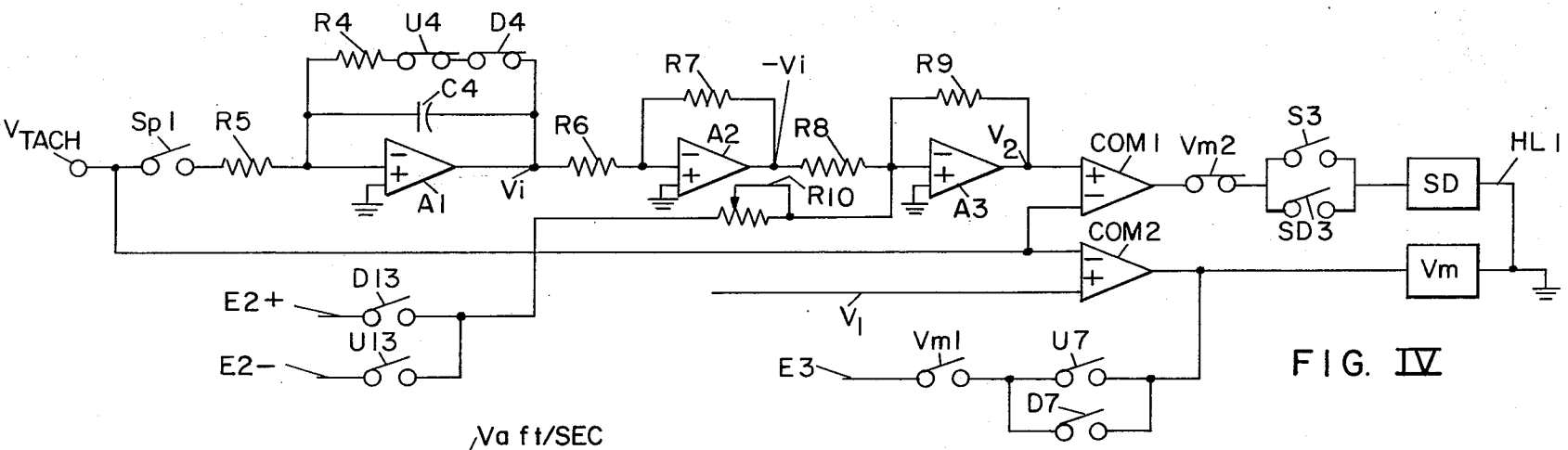
FIG. IV
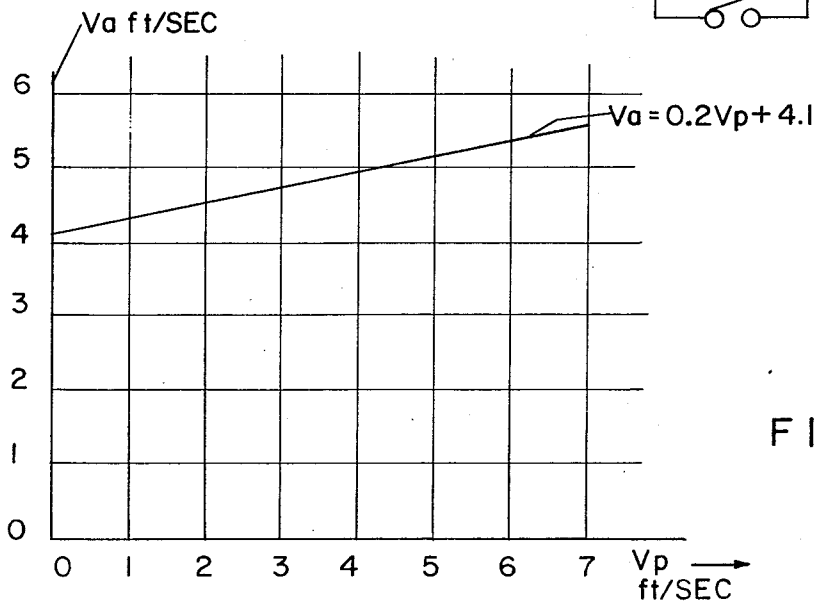
FIG. VI

ELEVATOR STOP CONTROL ARRANGEMENT

This invention relates to elevator control systems. More particularly, it concerns an arrangement for generating stopping signals to initiate stopping operations for an elevator car.

In order to permit elevator cars to make trips between adjacent landings in systems in which the stopping distance from rated speed is less than the typical distance between such adjacent landings it is common practice to employ landing selector apparatus. Part of this apparatus moves in synchronism with the car and produces a stopping signal for a landing, if it is desired to stop there, upon the arrival of the car at its rated speed stopping distance from the landing. Alternatively, in place of the landing selector apparatus in such systems a separate switch for each direction of travel to each landing is located in the hoistway for actuation by the car upon its arrival at the rated speed stopping distance from the respective landing in order to enable the generation of a stopping signal for that landing.

In some installations the rated speed is such as to require a stopping distance greater than one half the typical distance between adjacent landings but still less than this typical distance. In these, additional equipment common to all landings is sometimes employed with the foregoing arrangements to indicate whether or not a car is going to make a trip between adjacent landings. This equipment is needed to provide acceptable operations on such trips. Upon starting from any landing the car arrives at the rated speed stopping distance from the next landing in the direction of travel very shortly after acceleration has begun. Withoug the additional equipment referred to herein, the stopping signal on a trip between adjacent landings would be generated at the time of that arrival and would prevent the car from accelerating to a satisfactory speed on such a trip. Consequently, the time expanded on such trips would be extensive and unacceptable.

Even the operation provided by such additional equipment has not been totally acceptable, however. It typically limits the car to a speed well below the maximum it could attain on such trips consistent with passenger comfort. This is particularly so in installations in which the distance between each pair of adjacent landings is not the same. To overcome such objectionable operations some installations have also been provided with individual equipment for each direction in which a car can approach each landing on a trip from an adjacent landing. This equipment is utilized to indicate the arrival of the car at that distance from the respective landing which has been determined to be the suitable distance at which to generate a stopping signal on a trip from the adjacent landing in the appropriate direction. Excessive expenditures can be incurred in providing such individual equipment, however, not only because of the cost of the equipment but also as a result of the extra expense involved in installing it and adjusting it to operate properly.

It is an object of this invention to improve the operation of elevator cars.

It is another object of this invention to provide a simple control arrangement for elevator cars which travel at rated speeds requiring a stopping distance more than half but less than the whole typical distance between landings. The arrangement enables such cars to accelerate to optimum speeds consistent with passenger comfort on trips between adjacent landings regardless of variations in the distances between such landings.

One of the features of the invention is that it enables a car to continue to increase its speed after it reaches the rated speed stopping distance from a landing at which it is going to stop if it is traveling at less than rated speed when it reaches that point.

Another feature of the invention is that it utilizes the indication of the arrival of the car at its rated speed stopping distance from any landing to control the generation of stopping signals for that landing whether or not the car is traveling at rated speed upon its arrival at that location.

In carrying out the invention a delay means including a prescribed speed signal generator is employed which responds to the car traveling at less than its rated speed when it arrives at the rated speed stopping distance from a landing. This generator thereupon operates to produce a signal signifying the maximum speed the car can attain and still stop in a satisfactory manner at that landing. This signal is then compared with a signal signifying the instantaneous speed of the car produced by a tachometer generator driven by the hoisting motor. The delay means operates to delay the generation of a stopping signal in response to the registration of a call for the landing until the magnitude of the signal from the tachometer generator equals that of the signal from the prescribed speed signal generator.

One of the advantages of the invention is that it enables the car to start from a landing and stop for a call for the immediately succeeding landing notwithstanding the call is not in registration for the succeeding landing when the car is located at rated speed stopping distance from it. Such a stop is possible as long as the call is registered before the car speed exceeds the maximum speed signified by the output signal of the prescribed speed signal generator.

In accordance with the invention there is provided apparatus for generating signals to initiate stopping operations for an elevator car whose control system accelerates it in accordance with a prescribed pattern. Included in this apparatus is a position responsive means which operates in response to the arrival of the car at that predetermined distance from a landing at which a stopping operation is to be initiated when the car is traveling at rated speed in order for it to decelerate in a desired manner to a stop at the landing. Call registering means is provided which is operable to register calls for service for the landing. The apparatus also includes a stopping signal generator which is responsive to the operation of the position responsive means and to the registration of a call for the landing to generate a stopping signal which initiates a stopping operation to decelerate the car to a stop at the landing. Also included in the apparatus is delay means which responds to the arrival of the car at the forementioned predetermined distance when it is traveling at less than its rated speed and delays, for a predetermined period, the stopping signal generator from generating a stopping signal in response to the registration of a call at the landing.

Other objects, features and advantages of the invention will be apparent from the foregoing and from the following description when considered in conjunction with the appended claims and the accompanying drawing, in which:

FIG. I is a simplified representation of parts of an elevator installation including an elevator car and a portion of its hoistway together with other associated equipment;

FIGS. II and III taken together constitute a simplified wiring diagram of the control circuits for an elevator;

FIG. IV is a simplified wiring diagram of part of the presently preferred stopping signal generating circuits;

FIG. V is a graph of an approximation of the curve of velocity plotted against time for a typical elevator car operation; and FIG. VI is a curve of the relationship of velocities utilized in practicing this invention.

The following is a list of the names of the electromagnetic switches shown in the drawing. Listed adjacent these names are reference characters utilized throughout the specification to identify the switches and in the drawing to identify the actuating coils of the respective switches.

| | |
|---|---|
| 1C, 2C, 3C, TC | CAR CALL REGISTRATION SWITCHES* |
| 1U, 2U, 2D, 3U, 3D, TD | HALL CALL REGISTRATION SWITCHES* |
| D | DOWN DIRECTION SWITCH |
| EV | EVEN FLOOR SWITCH |
| EVD | DELAYED EVEN FLOOR SWITCH |
| 1FL, 2FL, 3FL, TFL | LANDING SWITCHES* |
| LVA | LEVELING APPROACH SWITCH |
| NT | HALL TIME SWITCH |
| OD | ODD FLOOR SWITCH |
| ODD | DELAYED ODD FLOOR SWITCH |
| S | START STOP CONTROL SWITCH* |
| SD | DELAYED SLOWDOWN SWITCH |
| Sp | STOPPING DISTANCE SWITCH |
| U | UP DIRECTION SWITCH |
| Vm | MAXIMUM VELOCITY SWITCH |
| XD | AUXILIARY DOWN DIRECTION SWITCH |
| XU | AUXILIARY UP DIRECTION SWITCH |
| Z | ZONE SWITCH* |

Switches designated with an asterisk (*) are of the latching type; their reset coils are distinguished from their actuating coils in the drawing by adding the suffix letter (*r*) to the previously listed reference characters used to identify their respective actuating coils. These same reference characters bearing the suffix letter (*r*) are also employed in the specification to identify the reset coils of the respective switches.

Prefix numerals included in certain of the above and other reference characters employed in this application indicate the individual landings with which the equipment identified by those reference characters is associated. The prefix letter T indicates that the equipment with which it is used is associated with the top landing.

Electromechanical switches shown on the drawing are designated as follows:

| | |
|---|---|
| EM | EVEN INDUCTOR SWITCH |
| LVD | DOWN LEVELING SWITCH |
| LVU | UP LEVELING SWITCH |
| O | ODD INDUCTOR SWITCH |

Numerical suffixes are appended to the above reference characters for the electromagnetic and electromechanical switches in both the specification and drawing to identify the contacts of the respective switches.

Electromagnetic switches are shown in the deenergized and reset states while the electromechanical switches are illustrated in the unoperated state.

Resistors, capacitators and rectifiers are identified in the drawing by the reference characters R, C, and CR respectively. Appropriate suffix numerals are appended to these characters to differentiate one element from another.

It is to be understood that to facilitate the disclosure of the invention it is illustrated in a system which is much simpler than would be found in a commercial installation.

Referring to FIG. I of the drawing, elevator car CA and counterweight CW are suspended in typical fashion from hoist ropes HR which pass over sheave TS to be driven thereby when hoist motor M rotates the sheave. Tachometer TACH comprises a speed responsive means and is driven by motor M to provide an output voltage signal along line $V_{TACH}$ proportional to car speed. Odd and even inductor switches O and EM are mounted on the exterior of the car, so that each coacts with the appropriate odd and even groups of vertically disposed floor vanes 1FVD, 2FVU, 2FVD, 3FVU, 3FVD and TFVU (FIG. I) to operate contacts O1 and EM1, respectively (FIG. III). Together these switches and vanes comprise the position responsive means of the apparatus disclosed herein.

A different floor vane is provided for each direction in which the car can approach each landing. The vanes associated with the respective up and down directions are identified by the suffix letters U and D appended to their respective reference characters.

Each floor vane includes both inner and outer active sections separated by an inactive section. The associated inductor switch EM or O is activated and released upon entering and leaving the zone of influence of each active section of each of its associated vanes. Each vane is so located in the hoistway with respect to its associated landing that its respective inductor switch leaves the zone of influence of its outer active section 1DO, 2UO, 2DO, etc. upon elevator car CA arriving at rated speed stopping distance from the landing in its approach to it in the direction associated with the respective floor vane. Entry into each outer active section occurs sufficiently in advance of the rated speed stopping distance to permit the operation of the circuitry of landing switches, 1FL, 2FL etc. (FIG. III) in response to the activation of the respective inductor switches EM and O to produce the proper indications of the location of elevator car CA.

Inner active section 1DI, 2UI, 2DI, etc. are located in relation to their respective landings to provide a proper transition from main operation to leveling operation during deceleration. The latter operation is well known and in the disclosed embodiment is provided by the cooperation of up and down leveling switches LVU and LVD mounted on car CA with the associated leveling cams 1LCU, 1LCD, 2LCU, 2LCD etc. which are appropriately mounted in the hoistway.

Up and down hall call buttons 1SU, 2SU, 2SD, etc. and car call buttons 1SC, 2SC etc. are illustrated both in FIG. I and FIG. II. These operate upon being pressed by a passenger and complete circuits from line E1+ to line HL1 through the set or actuating coils of the respective hall and car call switches to actuate those switches.

Amplifier A1 shown in FIG. IV comprises a portion of the delay means shown in that figure and is an operational amplifier arranged with capacitor C4 to form an integrator. This stores the magnitudes of the signals applied to it along line $V_{TACH}$ from tachometer TACH (FIG. I). The stored signals are applied along line $V_i$ to operational amplifier A2, arranged as an inverter. The signals from amplifier A2 are applied along line $-V_i$ to operational amplifier A3. This latter amplifier is arranged as a summing amplifier to operate as a prescribed speed signal generator and generate prescribed speed signals.

In response to both the input signals applied to it along line $-V_i$ and the bias signals applied to it along line E2+ or E2− through rheostat R10, amplifier A3 produces output signals along line $V_2$. These output signals are compared with the signals along line $V_{TACH}$ from tachometer generator TACH by comparator COM1. The latter produces an output voltage which energizes the coil of delayed slowdown switch SD whenever the magnitude of its input signal along line $V_2$ is greater than the magnitude of its input signal along line $V_{TACH}$ and operates to deenergize the coil when the magnitude of its two input signals are equal. The signals along line $V_{TACH}$ are also applied to comparator COM2 to cause it to produce a voltage to energize the coil of maximum velocity switch Vm whenever the magnitude of the signal along line $V_{TACH}$ equals that of the signal along line V1 which is scaled to represent the rated speed.

The curve of velocity versus time of FIG. V represents an approximation of speed as a function of time for a trip between adjacent landings by an elevator car with a duty rating for which this invention is appropriate. Missing from the curve are periods at the beginning and end of the cycle which would represent an increasing acceleration during the former period and a decreasing deceleration during the latter. Although the curve is an approximation it is sufficiently accurate to serve the purpose for which it is used. On a trip on which the car is not traveling at rated speed when it arrives at the rated speed stopping distance from a landing the curve can be used to determine the relationship between the car's speed at that distance and the maximum speed the car can attain before a stopping operation is to be initiated in order for it to stop at that landing in a desired manner on that trip.

In order to understand how this relationship is determined assume that the car accelerates and decelerates at constant rates of 4 feet per second per second and transfers from acceleration to deceleration at a constant rate of change of 8 feet per second per second per second. Also assume that under these conditions the stopping distance for the car traveling at rated speed is signified by the term STD. Since the curve of FIG. V represents a typical less than rated speed operation then the area under the curve represents the total distance $S_t$ traveled during the trip. Also since the time $t_p$ represents the time at which the car arrives at the rated speed stopping distance from the landing at which it is to stop at time $t_f$ the area under the curve from time $t_p$ to time $t_f$ equals this stopping distance STD. The stopping distance STD plus the distance traveled from tine $t_0$ to time $t_p$ represented by the reference character $S_p$ also equals the total distance $S_t$ traveled during the trip. Consequently, the total distance $S_t$ can be defined by the equation:

$$S_t = S_p + STD \quad (1)$$

or since $S_p = \frac{1}{2}V_p t_p$ equation (1) may be written as $$S_t = \tfrac{1}{2}V_p t_p + STD \quad (2)$$

It should be evident, from observation, that the total distance $S_t$ can also be defined by the equation:

$$s_t = \tfrac{1}{2}V_a t_a + S_k + S_c + S_s \quad (3)$$

Setting equation (2) equal to equation (3)

$$\tfrac{1}{2}V_p t_p + STD = \tfrac{1}{2}V_a t_a + S_k + S_c + S_s \quad (4)$$

Since the curve is symetrical about time $t_x$ and the magnitude of the velocity $V_s$ is equal to the magnitude of the velocity $V_a$, $S_s = \frac{1}{2}V_a t_a$, therefore equation (4) can be rewritten:

$$\tfrac{1}{2}V_p t_p + STD = \tfrac{1}{2}V_a t_a + S_k + S_c + \tfrac{1}{2}V_a t_a \quad (5)$$

With the forementioned acceleration, deceleration and rates of charge thereof it can be shown by straightforward mathematics that:

$$S_k = \tfrac{2}{3} \text{ of a foot} \quad (6)$$

$$\text{and } S_c = V_a t_c \quad (7)$$

where $t_c = 1$ second

One second is the time it takes to go from velocity $V_a$ and an acceleration of 4 feet per second per second to velocity $V_a$ and a deceleration of 4 feet per second per second at a rate of change of 8 feet per second per second per second therefore $$S_c = V_a(1) = V_a \quad (8)$$

Equations 5, 6, and 8 can now be combined to give:

$$\tfrac{1}{2}V_p t_p + STD = V_a t_a + \tfrac{2}{3} + V_a \quad (9)$$

Moreover, since time is equal to velocity divided by acceleration and the acceleration is constant at 4fps[1] during times $t_p$ and $t_a$ equation (9) can be rewritten as $$\tfrac{1}{8}V_p^2 + STD = \tfrac{1}{4}V_a^2 + \tfrac{2}{3} + V_a$$

$$\text{or } V_p^2 = 2V_a^2 + 8V_a - 8STD + 5\tfrac{1}{3} \quad (10)$$

Equation 10 defines the relationship between the velocity of the car at its stopping distance point from a landing at which it is to stop and the maximum velocity the car can attain on that trip before a stopping operation is to be initiated if the car is to operate in accordance with the curve of FIG. V.

Where the stopping distance point is located eight feet from the landing as in the herein described embodiment, equation (10) can be rewritten $$V_p^2 = 2V_a^2 + 8V_a - 58\tfrac{2}{3} \quad (11)$$

or transposing and solving for $V_a$ $$V_a = -2 \pm \sqrt{\tfrac{1}{2}V_p^2 \quad 33\tfrac{1}{3}} \quad (12)$$

While those skilled in the art will realize that circuitry could readily be built to implement the solution of the positive portion of equation (12) it has been found satisfactory in the range of speeds of interest, namely up to approximately 400 fpm, to utilize a straight line approximation of equation (12) which is shown on FIG. VI and defined by the equation:

$$V_a = 0.2V_p + 4.1\ fps \qquad (13)$$

FIG. IV illustrates the circuitry utilized to implement the solution of equation (13).

To more fully appreciate the invention and the manner in which the preferred embodiment operates, assume that elevator car CA is located at the first landing. In these circumstances, first landing switch 1FL (coils FIG. III) is in the set condition, its set coil having been the last of its two coils to be energized. Zone switch Z (coils FIG. III), start-stop control switch S (coils FIG. II), landing switches 2FL, 3FL, TFL (coils FIG. III) and call registration switches 1U, 1C, 2U, etc. (coils FIG. II) are in the reset state, their reset coils being the last of their two coils to be energized. The remaining switches are in their deenergized states.

Assume a hall call is registered by an intending passenger pressing top hall call button TSD (FIG. II) causing the energization of the upper or set coil of top hall call registration switch TD through the completed circuit from line E1+ to line HL1. As a result contacts TD3 (FIG. II) close and power is applied to the coil of auxiliary up direction switch XU (coil FIG. II) through closed contacts NT4, TD3, rectifier CR1, and contacts D1 and XD6 causing auxiliary up direction switch XU to transfer to its actuated state closing contacts XU1 (FIG. II) and completing a circuit to the set coil of start-stop control switch S (coil FIG. II) through normally closed contacts NT2. As a result switch S transfers to its set condition closing contacts S1 in the circuit of the coil of up direction switch U (coil FIG. II) causing the energization of the coil by way of closed contacts S1, XU5, D2 and XD6. This actuates up direction switch U which in conjunction with start-stop control switch S may be utilized to start and operate elevator car CA in the up direction in any well known manner.

As an example of the manner in which up direction switch U and start stop control switch S may be utilized to start elevator car CA, assume car CA is installed in a system in which it is driven by a d.c. hoisting motor arranged in a Ward Leonard system with a self-excited d.c. generator. As is well known, switches S and U may be employed in such an installation to actuate accelerating switches the operation of which control the amount of current that flows in the generator's shunt field winding to start and accelerate the car. Alternatively, elevator car CA may be installed in a system in which it is driven by the a.c. motor of a control system of the type disclosed in U.S. Pat. No. 3,678,355. In that type of installation switches S and U may be employed to apply a step input voltage in the input of function error amplifier 24 of that patent which as explained therein will start and accelerate the car.

Energizing start-stop control switch S also activates the delayed slowdown means (FIG. IV) of this invention. Contacts S3 (FIG. IV) close in series with closed contacts Vm2 to connect the output of comparator COM1 to the coil of delayed slowdown switch SD (coil FIG. IV). Comparator COM1, a two input differential amplifier, as mentioned earlier, compares the magnitude of the output signal from summing amplifier A3 along line $V_2$, with the magnitude of the signal along line $V_{TACH}$. The signal along line $V_2$ generated as a result of the bias signal along line E2- applied through closed contacts U13 and input rheostat R10 to summing amplifier A3 is greater in magnitude than the signal on line $V_{TACH}$ when the car starts its movement in the up direction. Consequently, comparator COM1 produces an output signal which energizes the coil of delayed slowdown switch SD (FIG. IV) through closed contacts S3 and Vm2. Delayed slowdown switch SD thereupon transfers to its actuated state and closes contacts SD1. (FIG. II)

Closed contacts SD1, EVD4 and ODD4 connect line E1+ to the coil of stopping distance switch $S_p$ (coil FIG. II) energizing the coil to actuate the switch. When stopping distance switch $S_p$ transfers to its energized state it closes contacts $S_p1$ (FIG. IV) to connect the signal on line $V_{TACH}$ from tachometer generator TACH to the input resistor R5 of operational amplifier A1. This stores the output voltage along line $V_{TACH}$ on line $V_i$ for future use when contacts $S_p1$ open. Operational amplifier A2, connected as a standard inverter, applies the inverse of the signal on line $V_i$ to line $-V_i$. This inverted signal is connected to the second input resistor R8 of summing amplifier A3 and is added with the bias signal connected through rheostat R10 to maintain the magnitude of the signal along line $V_2$ greater than that along line $V_{TACH}$ and consequently maintain delayed slowdown switch SD actuated.

Continued acceleration and movement of car CA in the up direction brings even floor inductor switch EM into the zone of influence of outer active section 2UO of even floor vane 2FVU causing contacts EM1 (FIG. III) to close. This completes a circuit to the set coil of second landing switch 2FL (coils FIG. III) through contacts E1, XU9 and 1FL5. As a result second landing switch 2FL operates to its set condition signifying that the car is approaching the second landing. Simultaneously, a circuit is also completed to the coil of even floor switch EV (coil FIG. III) through closed contacts E1 and Z6. Upon this switch transferring to its actuated state contacts EV5 close to energize the set coil of zone switch Z (coil FIG. III) through those closed contacts and contacts E1. Operating zone switch Z to its set condition closes contacts Z3 and completes the circuit to reset coil of first landing switch 1FL (coils FIG. III) through contacts EM1, Z3, 1FL3. The operation of first landing switch 1FL to its reset condition together with the previously described operation of second landing switch 2FL to its set condition completes the transfer of the indicated location of the car from the first landing to the second.

The actuation of even floor switch EV also closes contacts EV1 to complete a circuit to the coil of delayed even floor switch EVD (coil FIG. II), through those contacts and closed contacts SD1 of actuated delayed slowdown switch SD. As a result, delayed even floor switch EVD is actuated to enable car CA, as will be explained, to continue to be able to stop at the second landing in response to a second landing call notwithstanding the call may be registered after the car has traveled beyond the point identifying the rated speed stopping distance from the second landing.

The actuation of delayed even floor switch EVD opens contacts EVD4 (FIG. II) to interrupt the circuit of the coil of stopping distance switch $S_p$. This causes the switch to separate its contacts $S_p1$ (FIG. IV) disconnecting line $V_{TACH}$ from input resistor R5 of amplifier A1. When this occurs, the output voltage of tachometer TACH (FIG. I) at that instant is stored by capacitor C4 (FIG. IV). This voltage is applied along line $V_i$ and represents the speed at which the car is traveling at that instant in its movement through the zone of influence of outer action section 2UO (FIG. I) of even floor vane 2FVU. By design these outer zones are chosen to be only large enough to enable a car traveling at rated speed to maintain the even and odd floor switches EV and OD in their actuated states for a sufficient time to permit the reset of start-stop control switch S and a respective car and/or hall call registration switch 1U, 1C, 2U, 2C, 2D, etc. As will be understood the length of these zones, accordingly, is relatively small. Consequently, even though the car is not now traveling at its rated speed, for present purposes, the speed at which it is traveling when contacts Sp1 open can be considered the speed at the rated speed stopping distance from the second landing which has been previously identified as the point at which even inductor EM exits from the zone of influence of outer active section 2UO. The speed at the rated speed stopping distance as earlier explained in connection with equations (1) through (13) is identified by the reference character $V_p$ and is utilized in determining the maximum speed, $V_a$, the car can attain on a less than rated speed trip before it must begin its stopping operation. In accordance with the present invention the voltage stored on capacitor C4 and applied to line $V_i$ when contacts Sp1 open is employed as the speed $V_p$ at the rated speed stopping distance in determining the maximum speed the car can attain.

After inversion by amplifier A2, the voltage applied along line $V_i$ is transmitted by line $-V_i$ to input resistor R8 of amplifier A3. Also transmitted to this amplifier through input resistor R10 for summation with the voltage along line $-V_i$ is the bias voltage applied along line E2−. The magnitude of this bias voltage in relationship with the magnitude of the voltage along line $-V_i$ together with the characteristics of amplifier A3 and the values of resistor R8 and R10 are such as to cause the voltage produced on line $V_2$ to be equal to two-tenths the voltage on line $V_i$ plus a voltage equivalent to 4.1 feet per second. As a consequence, this equipment implements the solution of equation (13) namely that $$Va = 0.2V_p + 4.1$$

and accordingly the voltage applied along line $V_2$ represents the maximum speed the car can attain before it must begin its stopping operation if it is to stop satisfactorily at the second landing on this trip. Since no call is in registration for the second landing at this time, the voltage along line $V_2$ is maintained for future use if needed.

Further motion of the car removes inductor switch EM from the zone of influence of outer active section 2UO of even floor vane 2FVU causing contacts EM1 to open. This deenergizes the coil of even floor switch EV by interrupting its circuit to line E1+, thereby releasing the switch. This, as mentioned earlier, signifies that car CA is located at that point identifying the rated speed stopping distance from the second landing.

To more fully understand how the invention enables the car to stop for a call registered at the second landing even though it is registered after the car is closer than the rated speed stopping distance from the landing, assume that shortly after even floor switch EV is released, a prospective passenger presses the second landing up hall call button 2SU (FIG. II). This causes the registration of a second landing up hall call by energizing the set coil of the up hall call registration switch 2U (coil FIG. II) through the completed circuit from line E1+ to HL1, actuating the switch to its set state.

The operation of second hall call registration switch 2U to its set state closes contacts 2U1. These contacts are in series with reset coil Sr of start-stop control switch S, closed contacts EVD3, 2FL1 and XD4 and reset coil 2U*r* (FIG. II) of the hall call registration switch 2U. Thus the actuation of second hall call switch 2U to its set state, closes of its own contacts 2U1, immediately energizing its reset coil 2U*r* and transferring itself to its reset state. Simultaneously, however, reset coil Sr of start-stop control switch S (coil FIG. II) is energized causing that switch also to assume its reset state.

As is well known, the transfer of start-stop control switch S to its reset condition when the car is traveling at rated speed is utilized to initiate the deceleration of the car. In the forementioned d.c. motor drive system of the self-excited Ward-Leonard type it is most commonly employed to release the highest order acceleration switch. The lower order ones being released as the car arrives at predetermined distances from the landing at which it is stopping. In the a.c. motor drive system of the type disclosed in the previously identified U.S. patent it is employed to remove the step input voltage which as was previously discussed would be applied to function error amplifier 24 to start and accelerate the car and to substitute therefor a leveling speed voltage to cause the car to decelerate to its leveling speed.

Notwithstanding start-stop control switch S has been transferred to its reset condition, however, the continued actuation of delayed slowdown switch SD can be employed in any suitable manner by those skilled in the art to delay the initiation of the deceleration of the car. Delayed slowdown switch SD is maintained actuated until the speed of car CA as signified by the signal along line $V_{TACH}$ equals the prescribed speed signal generated by the prescribed speed signal generator comprising amplifier A3 and applied along line V2. At that time the two signals applied to comparator COM1 are equal and, as stated previously, under such circumstances the coil of switch SD is deenergized and the switch releases to its unactuated state.

The release of delayed slowdown switch SD in conjunction with the previous release of start-stop control switch S can be employed to initiate the deceleration of the car in any suitable manner similar to the manner in which the release of switch S when the car is traveling at rated speed initiates deceleration. Further slowdown of the car to its leveling speed can also be provided in a manner similar to that provided when the car is on a atrip on which it has attained rated speed.

Upon approaching the zone of influence of inner active section 2UI (FIG. I) of even floor vane 2FVU, even floor inductor switch is again actuated and closes contacts EM1 (FIG. III). This completes a circuit to the coil of leveling approach switch LVA through the additionally closed contacts Z1, U11, OD2, EV2 and S6 and actuates the switch to open its contacts LVA1.

In the meantime before these contacts open, up leveling switch LVU engages second landing up leveling cam 2LCU (FIG. I) causing its contacts to close. This maintains up direction switch U actuated through the circuit including closed contacts LVU (FIG. II) when contacts LVA1 open. This circuit is maintained to enable the car to operate at leveling speed until it arrives at the landing and up leveling switch LVU is disengaged from up leveling cam 2LCU.

Maximum velocity switch Vm (coil FIG. IV) is provided to prevent delayed stopping switch SD from interferring with the initiation of the deceleration operation in response to the release of start-stop control switch S on trips on which the car attains its rated speed. Upon that occurrence the magnitude of the signal along line $V_{TACH}$ equals the magnitude of the signal along line $V_1$ and comparator COM2 produces a voltage sufficient to energize the coil of maximum velocity switch Vm. As a consequence the switch operates to its actuated condition and opens its contacts Vm2 (FIG. IV) in the coil circuit of delayed slowdown switch SD. Once actuated maxium velocity switch Vm is maintained in that condition for the remainder of a trip by the current applied to its coil from the supply applied along line E3 through contacts Vm1 and U7 or D7.

Various modifications to the foregoing arrangement will be evident to those skilled in the art and for that reason it is intended that the arrangement be considered illustrative only and not limiting in any sense.

What is claimed is:

1. Apparatus for the control of an elevator car which accelerates in accordance with prescribed pattern, said apparatus generating signals to initiate stopping sequences for the car and including, position responsive means operating in response to the location of the car at that predetermined distance from a landing at which a stopping operation is to be initiated when the car is traveling at its rated speed in order for it to decelerate in a desired manner to a stop at said landing; call registering means operable to register calls for service for said landing; a stopping switch operating in response to the operation of said position responsive means and to the existence of the registration of a call for said landing when said car is traveling at said rated speed to initiate a stopping operation to decelerate said car in said desired manner to a stop at said landing; and delay means operating on those trips in which the car is traveling at less than its rated speed when it arrives at said predetermined distance from said landing sensing the arrival of the car at said predetermined distance from said landing while traveling at less than said rated speed and operating to enable said stopping switch to initiate a stopping operation in response to a call for said landing registered after said car approaches closer to said landing than said predetermined distance.

2. Apparatus according to claim 1, wherein said delay means responds to the instantaneous speed of said car at said predetermined distance and delays the initiation of a stopping operation until said car attains a prescribed speed determined in accordance with said instantaneous speed at said predetermined distance.

3. Apparatus for the control system of an elevator car which accelerates in accordance with a prescribed pattern, said apparatus generating signals to initiate stopping sequences for the car and including, position responsive means operating in response to the location of the car at that predetermined distance from a landing at which a stopping operation is to be initiated when the car is traveling at rated speed in order for it to decelerate in a desired manner to a stop at said landing; call registering means operable to register calls for service for said landing; a stopping switch responsive to the operation of said position responsive means and to the registration of a call at said landing for initiating a stopping operation to decelerate said car in said desired manner to a stop at said landing; speed responsive means operative in response to the instantaneous speed of said car to produce a voltage representative thereof; signal storage menas including a capacitive circuit receiving and storing the voltage representing the instantaneous speed at said predetermined distance; a bias signal means operative to produce a bias voltage; a summing amplifier operative to sum the stored voltage and said bias voltage to produce a voltage at said predetermined distance representing a prescribed speed; said prescribed speed on each particular trip on which the car has not attained its rated speed upon arriving at said predetermined distance being that speed which is determined in accordance with said prescribed pattern to be the greatest the car can attain on that trip before initiating a stopping operation if it is to decelerate in a desired manner to a stop at said landing; and a comparator operating in response to said voltage representing said instantaneous speed and said voltage representing said prescribed speed to cause said stopping switch means to operate when said car is closed to said landing than said predetermined distance provided a call for said landing is registered before said voltage representing said instantaneous speed is within a predetermined relationship of said voltage representing said prescribed speed,

4. Apparatus for the control system of an elevator car which accelerates in accordance with a prescribed pattern, said apparatus generating signals to initiate stopping sequences for the car and comprising, position responsive means operating in response to the location of the car at that predetermined distance from a landing at which a stopping operation is to be initiated when the car is traveling at its rated speed in order for it to decelerate in a desired manner to a stop at said landing; call registering means operable to register calls for service for said landing; a stopping switch for initiating a stopping operation to decelerate said car in said desired manner to a stop at said landing, said stopping switch operating in response to the operation of said position responsive means when a call is in registration for said landing; and delay means for delaying the initiation of a stopping operation on a trip on which said car has not attained its rated speed upon its arrival at said predetermined distance from said landing; said delay means including speed responsive means operating in response to the instantaneous speed of said car to produce a signal representative thereof, a prescribed speed signal generator operating in response to the arrival of said car at said predetermined distance from said landing and generating a prescribed speed signal at said predetermined distance which is a function of the instantaneous speed of the car upon said arrival, and a comparator circuit producing a signal for delaying the initiation of a stopping operation on said trip until a predetermined relationship exists between said instantaneous speed signal and said prescribed speed signal.

5. Apparatus according to claim 4, wherein said comparator circuit is rendered ineffective to produce a signal for delaying the initiation of a stopping operation on any trip upon the car attaining its rated speed.

6. Apparatus according to claim 5, wherein said delay means includes signal storage means receiving and storing the instantaneous speed signal produced at said predetermined distance; a bias signal means operative to produce a bias signal and a summing amplifier operative to sum the stored instantaneous speed signal and said bias signal to produce said prescribed speed signal.

7. Apparatus according to claim 6, wherein said delay means includes delayed slowdown switch circuitry responsive to said comparator circuit signal and enabling said stopping switch to operate in response to the registration of a call for said landing when said car is closer than said predetermined distance from said landing.

8. Apparatus according to claim 7, wherein said prescribed speed on each particular trip on which said car does not attain its rated speed is that speed which is determined in accordance with said prescribed pattern to be the greatest it can attain on that trip before initiating its stopping sequence if it is to decelerate in said desired manner to a stop at said landing.

* * * * *